US008171656B2

(12) United States Patent
Salminen et al.

(10) Patent No.: US 8,171,656 B2
(45) Date of Patent: May 8, 2012

(54) SOLE STRUCTURE OF A SPORTS SHOE

(75) Inventors: Matti Salminen, Porvoo (FI); Teuvo Niskanen, Espoo (FI)

(73) Assignee: Karhu Sporting Goods Oy, Kitee (FI)

( * ) Notice: Subject to any disclaimer, the term of this patent is extended or adjusted under 35 U.S.C. 154(b) by 1031 days.

(21) Appl. No.: 11/918,729

(22) PCT Filed: Jun. 28, 2006

(86) PCT No.: PCT/FI2006/050291

§ 371 (c)(1),
(2), (4) Date: Feb. 21, 2008

(87) PCT Pub. No.: WO2007/003704

PCT Pub. Date: Jan. 11, 2007

(65) Prior Publication Data

US 2009/0019730 A1 Jan. 22, 2009

Related U.S. Application Data

(60) Provisional application No. 60/730,038, filed on Oct. 26, 2005.

(30) Foreign Application Priority Data

Jul. 1, 2005 (FI) ..... 20055373

(51) Int. Cl.
*A43B 13/00* (2006.01)
*A43B 13/18* (2006.01)
*A43B 5/06* (2006.01)

(52) U.S. Cl. ..... 36/25 R; 36/88; 36/107; 36/31

(58) Field of Classification Search ..... 36/25 R, 36/30 R, 31, 107, 108, 102, 88, 91, 92, 28; 3/92, 28

See application file for complete search history.

(56) References Cited

U.S. PATENT DOCUMENTS

| | | | | |
|---|---|---|---|---|
| 4,439,937 | A * | 4/1984 | Daswick | 36/107 |
| 4,757,620 | A | 7/1988 | Titola | |
| 4,768,295 | A * | 9/1988 | Ito | 36/28 |
| 4,815,221 | A * | 3/1989 | Diaz | 36/27 |
| 4,854,057 | A * | 8/1989 | Misevich et al. | 36/114 |
| 5,313,717 | A * | 5/1994 | Allen et al. | 36/28 |
| 5,727,335 | A * | 3/1998 | Kousaka et al. | 36/31 |

(Continued)

FOREIGN PATENT DOCUMENTS

DE 103 28 390 A1 1/2005

(Continued)

*Primary Examiner* — Marie Patterson
(74) *Attorney, Agent, or Firm* — Young & Thompson

(57) ABSTRACT

A sole structure of a sports shoe includes an outsole and an intermediate sole having a number of portions that is flexible and supports the foot during running. The intermediate sole includes a flexible body element extending along the entire length of the shoe, and a flexible heel absorption element extending to the heel area, and a support element fitted between them extending from the heel area to the ball area which is of a less flexible material than the body element or the heel absorption element. The support element includes a substantially plate-like heel portion and a shaped front portion, which are separated from each other by a substantially cross-directional support ridge protruding from the lower surface of the support element. The intermediate sole also includes an hourglass-shaped ball absorption element, a carbon fiber plate increasing the torsional rigidity of the support element and an arch support.

19 Claims, 5 Drawing Sheets

U.S. PATENT DOCUMENTS

| | | | | |
|---|---|---|---|---|
| 6,038,790 | A | 3/2000 | Pyle et al. | |
| 6,647,645 | B2 * | 11/2003 | Kita | 36/28 |
| 6,782,641 | B2 * | 8/2004 | Turner et al. | 36/29 |
| 7,040,040 | B2 * | 5/2006 | Meschan | 36/25 R |
| 7,263,788 | B2 * | 9/2007 | Johnson | 36/91 |
| 7,278,226 | B2 * | 10/2007 | Holden et al. | 36/35 R |
| 2003/0000109 | A1 | 1/2003 | Kita | |

FOREIGN PATENT DOCUMENTS

| | | |
|---|---|---|
| EP | 0 399 332 A1 | 11/1990 |

* cited by examiner

SOLE STRUCTURE OF A SPORTS SHOE

FIELD OF THE INVENTION

The invention relates to a sole structure of a sports shoe that comprises an outsole and a midsole consisting of a number of portions, which midsole is flexible and supports the foot during running.

BACKGROUND OF THE INVENTION

The function of a running shoe is, on the one hand, to help the act of running so that the runner progresses as economically as possible and, on the other hand, to protect the feet against stresses from running. In order to achieve these functions, various sports shoes have been developed, whose sole is formed to be flexible to reduce the stresses to the foot and to make the running more effective.

During running the muscles alternately stretch and contract. The running step consists of a flight phase and a support phase. During the flight phase the muscles are preactivated and prepare for the impact of the foot on the base, at which phase large reacting forces are directed at the base. At an impact phase the preactivated muscles are stretched (an eccentric phase) and store elastic energy in their structures, which energy can be utilised at a concentric phase that immediately follows the stretching. During a contact phase the runner produces by his/her muscle work a force (kinetic energy) that determines the direction of motion and acceleration of his/her centre of gravity at the flight phase. All the forces produced by the runner are conveyed to the base through a support surface formed by the running shoe. According to Newton's third law, a reacting force of the same amount but of the opposite direction is directed at the runner from the base. At the beginning of the impact phase this force is conveyed through the bones and tendons to the muscle-tendon complex, where it causes an increase in force production.

The running shoe plays a central role as a conveyor of force production between the running base and the runner. The geometry of the shoe and its rigidity and flexibility characteristics can affect the operation of regulatory systems that are important from the point of view of natural and economical movement. In addition, the geometry of the shoe allows directly influencing the magnitude of the lever arms and, through this, the requirements of force production.

A sole structure of a sports shoe is known from the U.S. Pat. No. 4,757,620, which sole structure comprises a cushioning and supporting structure placed between a wearing sole and an intermediate layer. This cushioning and supporting structure comprises a flexible toe portion substantially extending from a tip of the shoe to a ball area, a resilient heel portion tapering in a wedge-like manner from a rear edge of the shoe towards the forward tip of the shoe and extending at least over the heel area, and a body piece substantially extending from the rear edge of the shoe to the ball area of the foot or fitted over a zone adapted to fit against the heel and the arch of the foot above the heel portion, which body piece is substantially stiffer and harder than said heel portion and toe portion. Such a sole structure efficiently receives the impact shock directed at the runner's heel at a landing phase of the foot. At a rolling phase of the foot, the sole structure supports the arch of the foot, which reduces the stresses directed at the foot. At a take-off phase of the foot unnecessary sliding of the shoe is eliminated.

One of the functions of a running shoe is to protect the foot against erroneous postures, such as overpronation (the ankle rotating inward too much) or supination (a posture opposite to pronation). Known running shoes often use an overpronation protection that supports the foot during running. However, too much support may cause strain injuries as the support prevents the natural movement of the foot.

The object of the invention is provide an even better sole structure of a running shoe that promotes natural and economical movement and prevents the occurrence of strain injuries in advance.

In order to achieve these objects and those that come out later the sole structure according to the invention is characterised in what is presented in the characterising part of claim 1.

SUMMARY OF THE INVENTION

The midsole of the new sole structure consists of at least three portions, which portions are a flexible body element that extends along the entire length of the shoe, a flexible heel absorption element that extends to the heel area, and a support element which is sandwiched between the body element and the heel absorption element and extends from the heel area to the ball area. The support element is of a less flexible material than the body element and the heel absorption element between which it is sandwiched. In addition, the structure of the bones of the foot and the natural movement path at the different phases of the running step have been taken into account in the design of the support element.

In a preferred embodiment of the invention the support element comprises a substantially plate-like heel portion and a shaped front portion, which are separated from each other by a substantially cross-directional support ridge protruding from the lower surface of the support element. Preferably the support ridge comprises two bulges, of which a first one, located close to the inner edge of the shoe, is higher than a second one, located close to the outer edge of the shoe, and there is an area between said first and second bulge where the support ridge is lower than the bulges. Studies show that such a structure of a support element effectively supports the foot at the different phases of the step without restricting the natural movement path of the foot too much.

In one embodiment of the invention the upper surface of the support element is equipped with a depression fitted with a carbon fibre plate, the function of which is to increase the torsional rigidity of the support element. This is achieved by a carbon fibre plate manufactured in such a way that its cross-directional rigidity is higher than its longitudinal rigidity. Preferably the carbon fibre plate extends farther below the ball of the foot at the side of the outer edge of the shoe than at the side of the inner edge of the shoe. The rear part of the carbon fibre plate may be equipped with a star-shaped opening, which increases the flexibility of the support element equipped with the carbon fibre plate during heel impact.

The sole structure according to the invention can further be equipped with an hourglass-shaped ball absorption element, which is fitted in a depression at the ball of the foot in the body element. The ball absorption element is of a more flexible material than the body element. It is a common way to only arrange absorption in the middle of the ball area, which, in fact, is the most questionable place considering the anatomy of the foot. If an absorption element is only in the middle of the area, the long bones of the toes will become compressed in the peripheral areas of the shoe, which, as a repeated movement, is one of the important causes for problems in the foot area. It is known that the highest loading pressures occur at the edges of the distal ends of the metatarsal bones. When the absorption element is in the shape of an hourglass, the loading pressure is distributed more evenly in the entire ball area, which enables an effective and forward driving ball take-off.

The invention concerns a sole structure of a shoe implemented in a new way, whose structures follow and support the foot so that the preconditions for a natural and economical movement are maintained. In the development of the new sole structure anatomical and biomechanical factors have been taken as a starting point. The product development has especially focused on the geometry of the shoe as structural solutions have been found to play a central role as a conveyor of force production between the running base and the runner.

A measurement series has been implemented in the biomechanical laboratory of the University of Jyväskylä, whose aim was to analyse the operation of the new sole structure using biomechanical methods of study. In a comparison with two running shoes on the market, it was found that the shoe has no effect on the running technique or muscular activity modelling. On the basis of this, it can be assumed that the changes in reacting forces and pressure values between the different shoes are dependent on the geometry and shock absorption and flexibility characteristics of the shoe.

When the pressure loads directed at the foot were studied, it was found that with the new running shoe the loading values of heel shock absorption both in slow and fast running were 34% lower than when moving with the reference shoes. When the pressure loads on the ball area were examined, more evenly distributed pressure values could be found in the ball absorption area of the new running shoe than in the reference shoes. All the differences were statistically significant. The ball absorption area of the new shoe is located in line with anatomical structures (the distal ends of the metatarsal bones). At a ball take-off phase (a push phase) the lowest average and maximum forces were found with the new shoe, which shows that the direction of motion is maintained very horizontal. This could also be seen in the magnitude of the vertical impulse, which was lowest with the new shoe and statistically significant.

The transition from a heel impact phase to the push phase is called a "rolling effect". The rolling effect should be fast and balanced. The shoe should support and follow the natural movements of the foot. It could be found in the study that the new running shoe enables the fastest rolling effect to the push phase and the rolling effect is balanced while the average pressure centre moves along a natural path in the foot area. Large shifts of pressure to the outer or inner edges of the foot (too much supination or correspondingly pronation) did not occur. An even and fast rolling effect creates the preconditions for efficient force production and an economical step.

An interesting and important additional observation was made in the study of the economic efficiency of running, where one could run with the new running shoe with an on average four beats lower heart beat and on average 4% lower oxygen consumption under standard loading than with the reference shoes. This phenomenon can be explained by the results observed in force plate analyses, according to which the production of forward directed force was significantly higher with the new running shoe than with the reference shoes. The results clearly show that the economic efficiency of running can be significantly improved by running shoes and, through that, the energy consumption during running can be reduced. The changes observed in the studies can decisively influence the end result achieved by endurance runners, for example on a marathon.

BRIEF DESCRIPTION OF THE DRAWINGS

In the following the invention is described by reference to the attached figures of the drawings; however, the invention is not intended to be limited to their details.

DETAILED DESCRIPTION OF THE DRAWINGS

Figure 1:
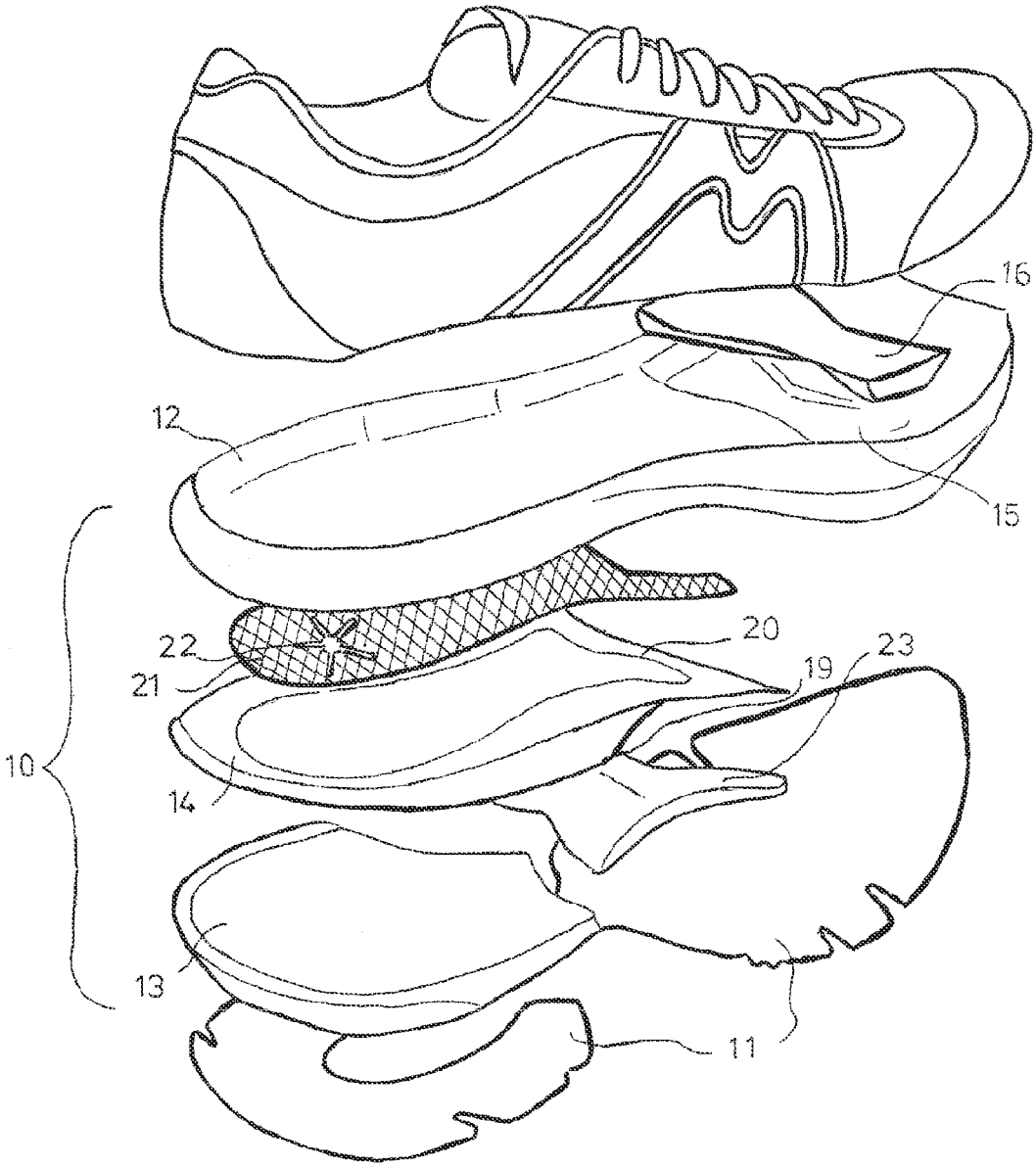
FIG. 1 is a perspective view of a sports shoe that is equipped with a sole structure according to the invention and wherein portions of the sole are detached from each other.

FIG. 1 shows a sports shoe equipped with a sole structure according to the invention. The sole structure comprises an outsole 11 and a midsole 10 consisting of a number of portions 12, 13, 14, 16, 21, 23, which midsole 10 is shaped and built so that it is flexible and supports the foot during running, as necessary. The outsole 11 consists of a heel portion and a ball portion.

The midsole 10 comprises a flexible body element 12 extending along the entire length of the shoe, a flexible heel absorption element 13 extending to the heel area and a support element 14 fitted between them extending from the heel area over the arch of the foot to the ball area. The support element 14 is of a stiffer material than the body element 12 and the heel absorption element 13 and is shaped to support and follow the natural movement of the foot during running. In addition to these three main portions, the midsole 10 also includes a ball absorption element 16, a carbon fibre plate 21 and an arch support 23.

Figure 2:
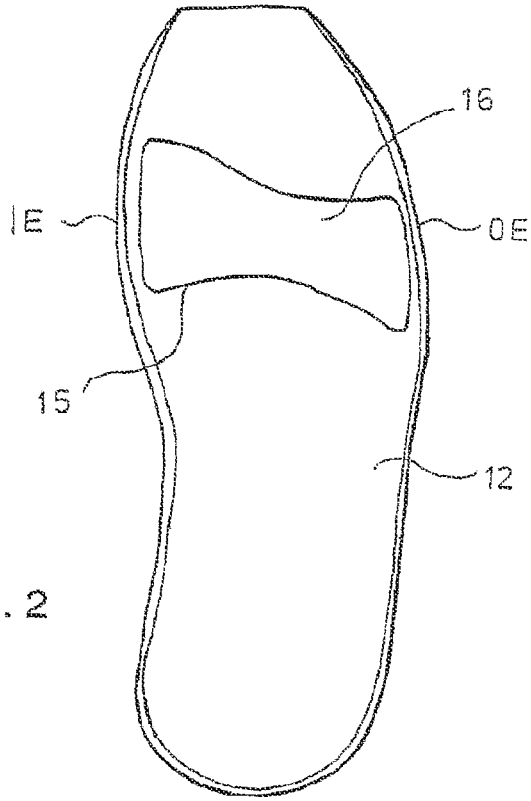
FIG. 2 shows a top plan view of a body element.

The body element 12 shown in more detail in FIG. 2 is manufactured from a polymer material, which provides good flexibility for the shoe. In the upper surface of the body element 12 there is a notch 15 at the ball of the foot, to which the hourglass-shaped ball absorption element 16 is fitted. The ball absorption element 16 is manufactured from an elastic special material, which reverts to its original shape immediately after loading has ended. The hourglass shape of the ball absorption element 16 follows closely the anatomical structure of the ball area (the distal ends of the metatarsal bones), in which case it provides the best possible absorption. At the same time, it helps direct the kinetic energy forward. It can further be seen from FIG. 2 that the width of the absorption element 16 is larger on the side of the foot's inner edge IE (or on the side of the big toe) than on the side of the foot's outer edge OE.

The heel absorption element 13 is a plate-like piece, whose edge on the side of the arch of the foot is shaped to fit into the special shape of the support element 14. In the middle of the lower surface of the heel absorption element 13 there is a depression in a manner known as such (not shown), which improves the flexibility of the shoe during heel impact and helps distribute the shock in a wider area. At the beginning of the contact phase of the running step a clear impact peak occurs, as a result of which the body is subjected to a high momentary load, which is connected to the generation of strain injuries. Thanks to the new midsole structure 10, the pressure from impact is distributed in a wider area. It has been found in studies that with the shoes according to the invention the loading values of the heel impact were 34% lower than with the reference shoes.

The heel absorption element 13 may be manufactured from the same or corresponding material as the body element 12. A suitable polymer material is for example ethylvinylacetate whose hardness is in the range 50 to 55 Shore C.

The support element 14 is located between the body element 12 and the heel absorption element 13, which support element is manufactured from a stiffer material than the body element 12 and the heel absorption element 13, which are intended to be flexible. A suitable material for the support element 14 is for example ethylvinylacetate whose hardness is in the range 60±3 Shore C. The support element 14 extends from the heel area to the ball area and it is shaped so that it supports and follows the natural movements of the foot. Thanks to its shaping it significantly accelerates the rolling effect of the step.

Figure 6:
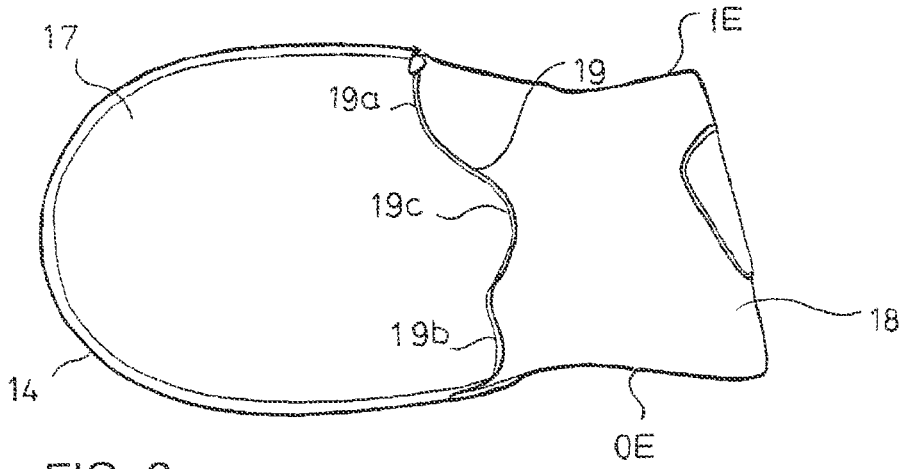
FIG. 6 shows a bottom view of the support element.
Figure 7:
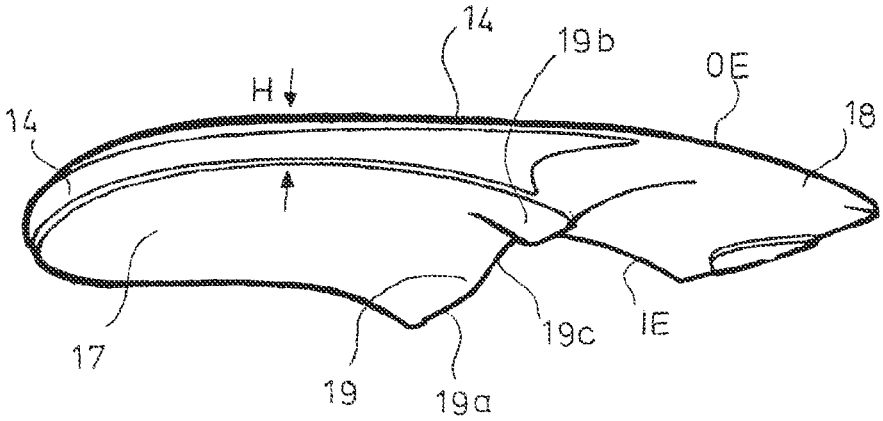
FIG. 7 is a perspective bottom view of the support element.
Figure 8:
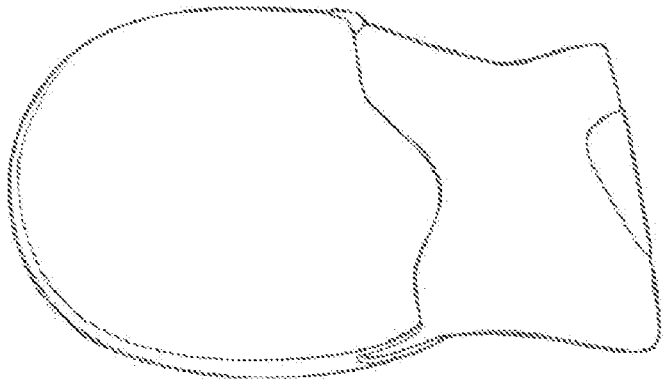
FIGS. 8-11 contain further illustrations of the support element.
Figure 9:
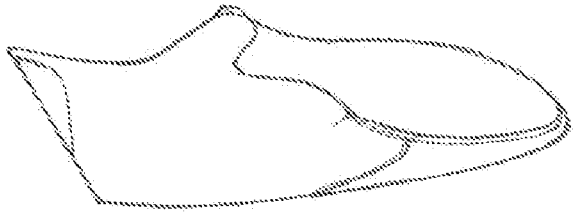
Figure 10:
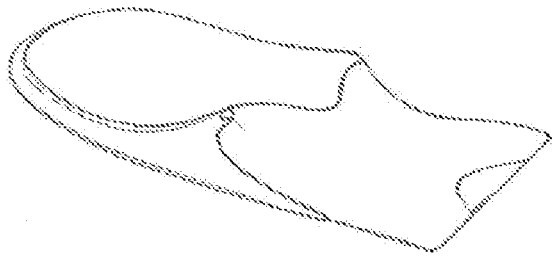
Figure 11:
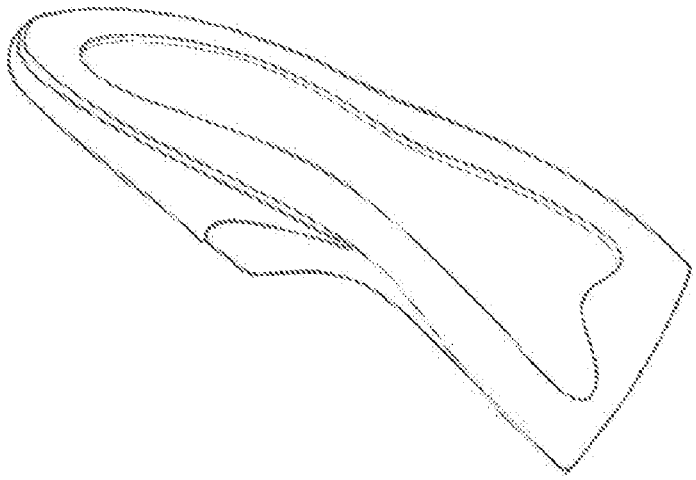

The shaping of the lower surface of the support element 14 can be seen in more detail in FIGS. 6 and 7, which show a bottom view of the support element 14. The support element 14 comprises a plate-like heel portion 17 and a shaped front portion 18 partly extending to the ball area. The heel portion 17 and the front portion 18 are separated from each other by a cross-directional support ridge 19 protruding from the lower surface of the support element 14 in the shaping of which the bones of the foot and the movement path at the different phases of running have been taken into account. The support ridge 19 comprises two bulges 19*a* and 19*b*, in between of which there is an area 19*c* lower than them. The first bulge 19*a* is close to the inner edge IE of the shoe and the other, lower bulge 19*b* is close to the outer edge OE of the shoe. As some kind of an assessment of the height of the support ridge it can be said that if the thickness of the support element 14 in the plate-like area of the heel portion 17 is H, the corresponding heights at the different parts of the support ridge 19 are as follows: at the bulge 19*a* 2.2 to 2.5 times H; at the bulge 19*b* 1.7 to 1.9 times H; and at the lowest area 19*c* of the support ridge 1.2 to 1.5 times H.

Figure 3:
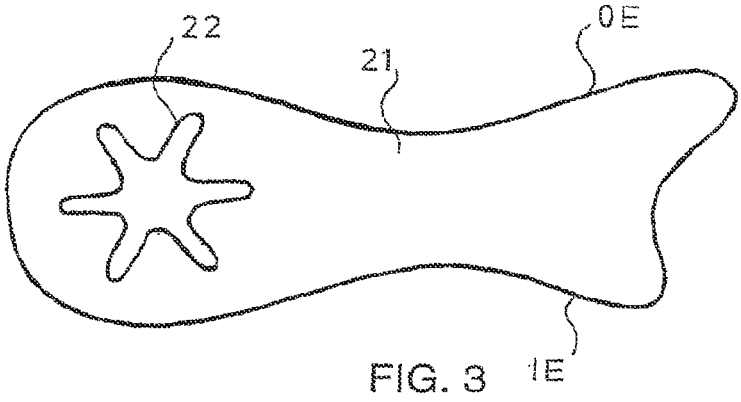
FIG. 3 shows a top plan view of a carbon fibre plate.
Figure 4:
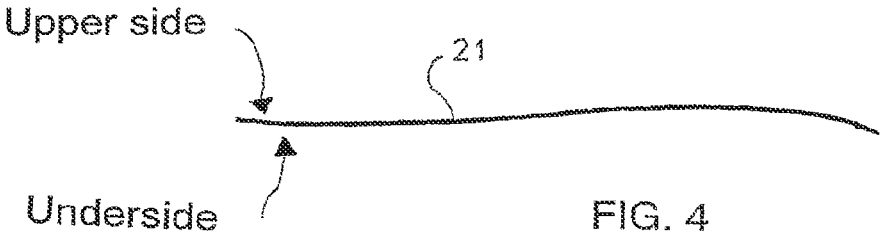
FIG. 4 shows a side view of the carbon fibre plate.
Figure 5:
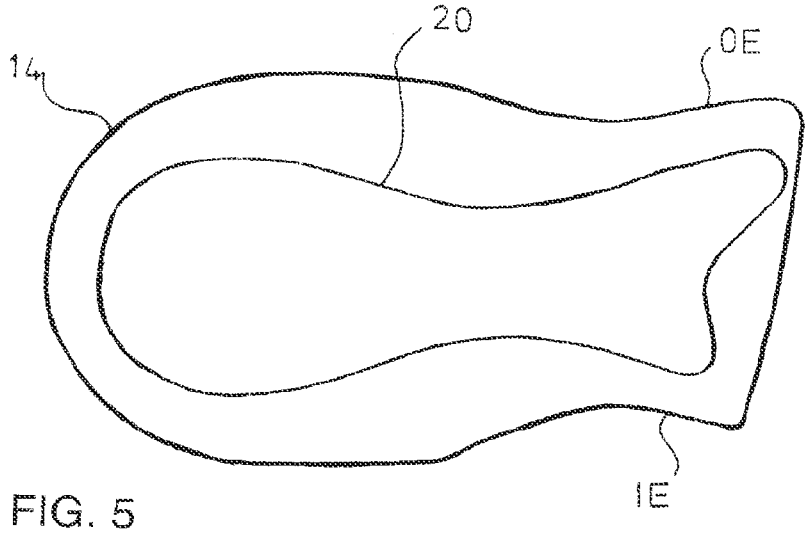
FIG. 5 shows a top plan view of a support element.

FIG. 5 shows a shallow depression 20 formed in the upper surface of the support element 14. It is intended to receive a plate 21 manufactured from carbon fibre, whose function is to increase the torsional rigidity of the support element 14. A top plan view of the carbon fibre plate 21 itself is shown in FIG. 3 and a side view in FIG. 4. The fibres in the carbon fibre plate 21 have been directed so that the cross-directional rigidity of the plate 21 is higher than its longitudinal rigidity. The carbon fibre plate 21 allows the inner rotation of the foot (pronation) occurring at the support phase but prevents excessive inner rotation (overpronation). It also maintains its flexibility in the pressure variation taking place longitudinally, in which case the pressure centre of the step follows a natural path.

The carbon fibre plate 21 is equipped with a star-shaped opening 22, located below the heel, that efficiently absorbs the heel impact occurring at the beginning of the contact phase and thus increases the flexibility of the support element 14 equipped with the carbon fibre plate 21 during heel impact. It can be seen from FIG. 4 that the carbon fibre plate 21 is shaped to be curved so that it forms a very gentle letter S viewed from the side direction. This shape substantially corresponds with the shape of the upper surface of the support element 14.

It should be noted that the carbon fibre plate 21, which increases the torsional rigidity of the sole structure, is an optional accessory, which is not needed when an overpronation protection is not needed in the shoe. Therefore, the running shoe according to the invention may also be manufactured without the carbon fibre plate 21.

In addition, the sole structure of the shoe is equipped with an arch support 23, whose function is to improve the orientation of the step in its natural movement path. The arch support 23 is preferably made from PVC plastic and it is shaped so that it guides movement to the outer edge of the foot.

A rubber material has been used in the heel portion of the outsole 11 that is excellently resistant to wear and thus, for its part, lengthens the useful life of the shoe. The rubber material in the ball area is elastic, in which case it enables an efficient push phase. Below the heel the hardness of the rubber material is 60±3 Shore A. Below the ball there is an area where the hardness of the rubber is about 65 Shore A.

Many modifications to the invention are possible within the sphere of the inventive idea as defined by the claims presented in the following.

The invention claimed is:

1. A sole structure of a sports shoe, comprising:

an outsole (11); and a midsole (10), which is flexible and supports a foot during running, the midsole (10) comprising:

a flexible body element (12) extending along an entire length of the sport shoe;

a flexible heel absorption element (13) extending to a heel area of the shoe; and a support element (14), which is sandwiched between the flexible body element (12) and the flexible heel absorption element (13) and extends from the heel area to a ball area of the sport shoe, and which is of a less flexible material than the flexible body element (12) or the flexible heel absorption element (13), wherein the support element (14) comprises a heel portion (17) and a shaped front portion (18), which are separated from each other by a support ridge (19) protruding from the lower surface of the support element (14), and wherein the support ridge (19) comprises two bulges (19*a*, 19*b*), the first one (19*a*) of which, located close to the medial edge of the shoe, is higher than the other one (19*b*), located close to the lateral edge of the shoe, and between said first and second bulges (19*a*, 19*b*) there is an area (19*c*) where the support ridge (19) is lower than the bulges (19*a*, 19*b*).

2. The sole structure according to claim 1, further comprising a carbon fibre plate (21) fitted to a depression (21) in the upper surface of the support element (14), wherein a rigidity of the carbon fibre plate along a direction across the carbon fibre plate is higher than along a direction longitudinal along the carbon fibre plate.

3. The sole structure according to claim 2, wherein the carbon fibre plate (21) extends farther below the ball area of the sport shoe at the side of the lateral edge of the sport shoe than at the side of the medial edge of the sport shoe.

4. The sole structure according to claim 2, further comprising a polygonal opening (22) at the rear part of the carbon fibre plate (21), which increases the flexibility of the support element (14) equipped with the carbon fibre plate (17) during heel impact.

5. The sole structure according to claim 1, further comprising a ball absorption element (16), which is fitted in a depression (15) in the flexible body element (12) and extends to a substantial part of the width of the sport shoe at the ball area of the sport shoe.

6. The sole structure according to claim 5, wherein the ball absorption element (16) is shaped like an hourglass having a narrow inner portion separating wider outer portions.

7. The sole structure according to claim 6, wherein the width of the ball absorption element (16) is larger at the medial edge of the sport shoe than at the lateral edge of the sport show.

8. The sole structure according to claim 1, further comprising an arch support (23) fitted below the support element (14).

9. The sole structure according to claim 1, wherein the body element and the heel absorption element (12, 13) are of a polymer material whose hardness is 50 to 55 Shore C and the support element (14) is of a polymer material whose hardness is 60±3 Shore C.

10. The sole structure according to claim 9, wherein said polymer material is ethylvinylacetate or comparable.

11. The sole structure according to claim 1, wherein the outsole (11) is of a rubber material whose hardness is 60±3 Shore C and it includes a portion located below the ball of the foot whose hardness is about 65 Shore C.

12. The sole structure according to claim 1, further comprising a carbon fibre plate (21) fitted to a depression (21) in the upper surface of the support element (14), wherein a rigidity of the carbon fibre plate along a direction across the carbon fibre plate is higher than along a direction longitudinal along the carbon fibre plate.

13. The sole structure according to claim 12, wherein the carbon fibre plate (21) extends farther below the ball area of the sport shoe at the side of the lateral edge of the shoe than at the side of the medial edge of the shoe.

14. The sole structure according to claim 3, further comprising a polygonal opening (22) at the rear part of the carbon fibre plate (21), which increases the flexibility of the support element (14) equipped with the carbon fibre plate (17) during heel impact.

15. The sole structure according to claim 1, further comprising a ball absorption element (16), which is fitted in a depression (15) in the body element (12) and extends to a substantial part of the width of the sport shoe at the ball area of the sport shoe.

16. The sole structure according to claim 1, further comprising an arch support (23) fitted below the support element (14).

17. The sole structure according to claim 1, wherein the body element and the heel absorption element (12, 13) are of a polymer material whose hardness is 50 to 55 Shore C and the support element (14) is of a polymer material whose hardness is 60±3 Shore C.

18. The sole structure according to claim 1, wherein the outsole (11) is of a rubber material whose hardness is 60±3 Shore C and it includes a portion located below the ball of the foot whose hardness is about 65 Shore C.

19. The sole structure according to claim 15, wherein the ball absorption element (16) is shaped like an hourglass having a narrow inner portion separating wider outer portions.

* * * * *